US010801230B2

(12) United States Patent
Durrant et al.

(10) Patent No.: US 10,801,230 B2
(45) Date of Patent: Oct. 13, 2020

(54) POST SUPPORT DEVICE FOR RELEASABLY MOUNTING A POST MEMBER

(71) Applicants: A'Lorre Scott Durrant, Littleton, CO (US); Chad Durrant, Dublin, CA (US)

(72) Inventors: A'Lorre Scott Durrant, Littleton, CO (US); Chad Durrant, Dublin, CA (US)

( * ) Notice: Subject to any disclaimer, the term of this patent is extended or adjusted under 35 U.S.C. 154(b) by 0 days.

(21) Appl. No.: 16/035,343

(22) Filed: Jul. 13, 2018

(65) Prior Publication Data

US 2020/0018086 A1 Jan. 16, 2020

(51) Int. Cl.
*E04H 12/22* (2006.01)
*E04H 17/22* (2006.01)

(52) U.S. Cl.
CPC ..... *E04H 12/2269* (2013.01); *E04H 12/2292* (2013.01); *E04H 17/22* (2013.01)

(58) Field of Classification Search
CPC . E04H 12/22; E04H 12/2253; E04H 12/2261; E04H 12/2269; E04H 22/2276; E04H 12/2284; E04H 12/2292; E04H 17/22
USPC ..... 52/165, 169.13, 170, 297; 248/156
See application file for complete search history.

(56) References Cited

U.S. PATENT DOCUMENTS

| | | | |
|---|---|---|---|
| 2,210,410 | A | 8/1940 | Johnske et al. |
| 2,945,659 | A | 7/1960 | McDonald |
| 3,698,144 | A | 10/1972 | Stratton |
| 4,099,354 | A | 7/1978 | Depirro |
| 4,133,154 | A | 1/1979 | Ruzicka |
| 4,588,157 | A | 5/1986 | Mills |
| 4,712,762 | A | 12/1987 | Liedle |
| 4,923,165 | A | 5/1990 | Cockman |
| 5,011,107 | A | 4/1991 | Reece |
| 5,090,656 | A | 2/1992 | Brown |
| 5,104,074 | A | 4/1992 | Malloy |
| 5,625,988 | A | 5/1997 | Killick |
| 5,632,464 | A | 5/1997 | Aberle |
| 5,752,349 | A | 5/1998 | Fitzsimmons et al. |
| 5,881,495 | A | 3/1999 | Clark |
| 5,913,778 | A | 6/1999 | Hying et al. |
| 6,041,559 | A | 3/2000 | Schickert et al. |
| 6,202,369 | B1 | 3/2001 | Partee et al. |
| 6,273,390 | B1 | 8/2001 | Meyer |
| 6,308,926 | B1 | 10/2001 | Meyer |
| 6,340,147 | B1 | 1/2002 | Dymarczyk |
| 6,389,760 | B1 * | 5/2002 | McDonnell ..... A63B 71/028 248/156 |

(Continued)

OTHER PUBLICATIONS

ROBZ40, replace a fence post using a vacuum cleaner, Video, Jan. 25, 2010. https://www.youtube.com/watch?v=9A8i6mouohw.

*Primary Examiner* — William V Gilbert
(74) *Attorney, Agent, or Firm* — Foster E. Dobry

(57) ABSTRACT

A post support device comprising a rigid insert portion having a body interposed between a top opening and a bottom end, said body defining a space therein. A post member is releasably secured in the rigid insert portion with a granular material, in combination with retainer members and a sealant portion. In the event the post member decomposes or breaks, the post member may be replaced by removing the sealant portion, retainer members, and the post member. The post support device enables the user to replace post members while maintaining the original spacing of the fence structure.

18 Claims, 5 Drawing Sheets

(56) References Cited

U.S. PATENT DOCUMENTS

| | | | | |
|---|---|---|---|---|
| 7,055,807 | B2 * | 6/2006 | Pesta | E04H 12/2269 160/351 |
| 7,377,020 | B1 | 5/2008 | Bartling et al. | |
| 7,621,080 | B2 * | 11/2009 | Stanfield | E04H 12/2292 52/170 |
| 7,730,675 | B2 | 6/2010 | Hill | |
| 8,782,978 | B1 * | 7/2014 | Frenette | E04H 12/2269 248/519 |
| 9,732,540 | B1 | 8/2017 | Jansen | |
| 2006/0157631 | A1 | 6/2006 | Cunningham et al. | |
| 2009/0320396 | A1 * | 12/2009 | Knudsen | E04H 12/2269 52/297 |

* cited by examiner

POST SUPPORT DEVICE FOR RELEASABLY MOUNTING A POST MEMBER

FIELD OF THE INVENTION

The invention relates generally to the field of fence construction.

BACKGROUND OF THE RELATED ART

Fencing establishes the metes and bounds of a parcel of land and is especially important for containing domesticated animals. Fence construction requires installation of post members in the ground, attachment of rails to the post members, and mounting of fence boards to the rails. Mounting of the post members for fence construction is a widely known process, typically employing concrete to fix a post member in an augured hole.

Concrete adequately secures the post members; however, this method promotes decomposition and subsequent breakage of wooden post members. When the decomposed wooden post member needs to be replaced, it traditionally required either an adapter, or removal and replacement of the concrete. Replacement of the concrete—or using an adapter—leads to a decrease in strength of the fencing system and promotes increased wear and tear on the fence structure.

Additionally, mounting the post member in concrete makes changing post members extremely difficult. Should a design change call for wooden posts to be replaced with metal posts, for example, it would be prohibitively expensive for a builder to replace wooden post members mounted in concrete with metal post members.

Therefore, it is desirable to maintain the spacing of the original installation, to balance the load across all post members, and preserve the aesthetic of the original fence, while also easing replacement of post members, whether replacement is necessitated by decomposition or a change in design.

SUMMARY OF THE INVENTION

The present invention solves the problem outlined above by providing a post support device for mounting post members that maintains the original spacing of the fence and promotes easy changing of post members.

In the preferred embodiment, the post support device comprises a rigid insert portion which is mounted in a stabilizing material, such as concrete or aggregate. The rigid insert portion is mounted at a depth of at least 25 percent of the post member length. This depth provides adequate support for the post member.

In another embodiment, the top opening of the rigid insert portion consists of a trimmable portion. The trimmable portion permits the user to adjust the top opening to accommodate a shorter post member length. For example, the user may cut the trimmable section when installing the rigid insert portion at a depth less than 25 percent of the post member length.

The rigid insert portion may be mounted with or without a post member. This facilitates quicker installation of the fencing system, as the post member does not need to be selected prior to installation of the post support device.

In the preferred embodiment, the rigid insert portion is constructed from a moldable hydrophobic material, such as high-or-low-density polyethylene, which prevents the ingress of water thereby lessening decomposition.

In the preferred embodiment, the rigid insert portion comprises a tapered rectangular prism-shaped geometry, having a top opening positioned opposite a bottom end connected by a body, the body having an inner and outer surface, defining a space therein. In another embodiment, the rigid insert portion comprises a tapered cylindrical shape.

The bottom end of the rigid insert portion is concentric with the top opening and has a cross section less than the cross section of the top opening, which results in a tapered body that connects to the bottom end at an obtuse angle. This obtuse angle facilitates location of the post member in the bottom end of the rigid insert portion.

The bottom end itself comprises at least one side and a base which join at a ninety-degree angle. In the preferred embodiment, the bottom end comprises a cuboid shape where the four planar sides and base of the bottom end join at a ninety-degree angle. In another embodiment, the bottom end comprises a cylindrical side portion which joins the base at a ninety-degree angle.

The bottom end of the rigid insert portion is designed to releasably secure the post member by closely conforming to the dimensions of the post member. This close conformation results in snug attachment of the distal end of the post member. In the preferred embodiment, the bottom end is approximately ⅛ of an inch larger than the post member.

In an alternative embodiment, the bottom end consists of two graduated sections; an upper bottom end and a lower bottom end. These two sections permit the user to adjust for different sized post members without needing to install a new rigid insert portion. To adjust for larger posts, the user fills the lower bottom end of the rigid insert portion with a granular material. This closes off the lower bottom end, and creates a new, larger upper bottom end. The new upper bottom end then releasably secures the distal end of the post member.

With the post member releasably secured by the bottom end, a granular material—such as fine grain, abiogenic sand—is poured in the space adjacent the post member. Best results are achieved when the granular material provides a quasi-fluid-like fill of the space between the post member and the rigid insert portion. In the preferred embodiment, the granular material has a particle size of between 0.060 millimeters and 6.5 millimeters. This size granular material best achieves the desired quasi-fluid-like fill of the rigid insert portion.

The granular material, in combination with the releasable attachment of the post member in the bottom end, allows the user to adjust the post member to the desired angle. This is accomplished by filling the space between the post member and the rigid insert portion with the granular material to the adjustment depth. The adjustment depth can range from 5 to 25 percent of the rigid insert portion capacity. In the preferred embodiment, the adjustment depth is approximately 25 percent of the rigid insert portion capacity. This depth of granular material permits adjustment of the post member. However, if the adjustment depth is greater than 25 percent of the rigid insert portion capacity, adjustment becomes impossible.

When the desired angle is achieved, the rigid insert portion is filled with granular material to the final depth. The final depth ranges from 75 to 100 percent of the capacity of the rigid insert portion. In the preferred embodiment, the final depth is 90 percent.

Once the granular material is filled to the final depth, retainer members, such as wooden shims, are placed in communication with the post member and the retainer member supports mounted on the inner surface of the rigid insert portion. The retainer members releasably secure the post member.

Finally, with the post member secured by the retainer member, a sealant portion—such as silicone caulk—is applied, covering the space adjacent the intersection of the top opening, retainer member, and post member. The sealant portion serves two purposes: it secures the retainer members and prevents the ingress of moisture into the rigid insert portion.

In the event of post member decomposition, the post member may be replaced by first removing the sealant portion and retainer members. Next, the remnants of the old post member can be grasped and removed by pulling vertically from the rigid insert portion, without needing to remove the granular material. Once the post member is removed from the rigid insert portion, the residual granular material is also removed, and a new post member is installed.

In the event the post member is significantly decomposed and cannot be grasped—or has broken below the top opening of the rigid ground insert—the granular material must be removed after the sealant portion and retainer members are removed. A post member is significantly decomposed if it has decomposed to a degree such that it can no longer be grasped. The user must first remove a sufficient amount of granular material to reveal the significantly decomposed post member. Once the granular material is removed, the user can grasp and remove the significantly decomposed post member.

This invention provides a post member installation with very good strength and stability against lateral forces, such as those experienced during heavy winds. While the invention provides excellent strength to maintain a solid post member installation, it also permits easy removal and replacement of the post member since there is minimal retention force on the post member when extracting in a vertical direction from the rigid insert portion.

DETAILED DESCRIPTION OF THE PREFERRED EMBODIMENTS

Figure 1:
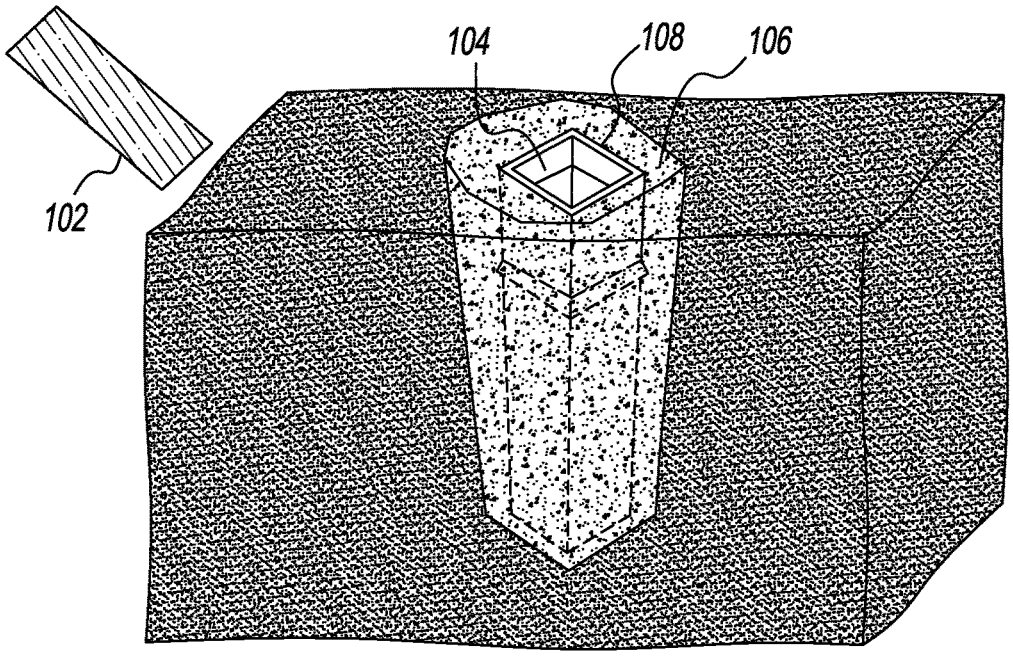
FIG. 1 is a perspective view of the current invention mounted in a stabilizing material.

FIG. 1 depicts an embodiment of the post support device, which consists of a rigid insert portion 104 mounted in a stabilizing material 106 such as concrete, aggregate, or other organic or inorganic material.

The rigid insert portion 104 is mounted such that the top opening 108 lies within plus or minus 10 centimeters of the top of the stabilizing material 106. In the preferred embodiment, the top opening 108 of the rigid insert portion 104 is mounted approximately flush with the top of the stabilizing material 106.

Installing the rigid insert portion 104 in the stabilizing material 106 allows for installation of the rigid insert portion 104 without a post member 102. This facilitates quicker installation of a fencing system by permitting an installer to mount the rigid insert portion 104 prior to selecting a post member 102. Other post member installation mechanisms require that the post member 102 be contemporaneously mounted with the securing means, which increases construction time.

The rigid insert portion 104 is mounted at a depth of at least 25 percent of the post member 102 length. For example, for a typical 8-foot post member 102 the rigid insert portion 104 is buried to a depth of at least 25 percent of the post member's 102 length, or 24 inches, into the stabilizing material 106. This depth provides adequate resistance to wind loads, while not requiring the installer to remove an excessive amount of stabilizing material 106. In the preferred embodiment, the rigid insert portion 104 is mounted at a depth of at least 22 inches, however shorter post member 102 lengths would permit a shallower installation depth for the rigid insert portion 104.

Figure 2:
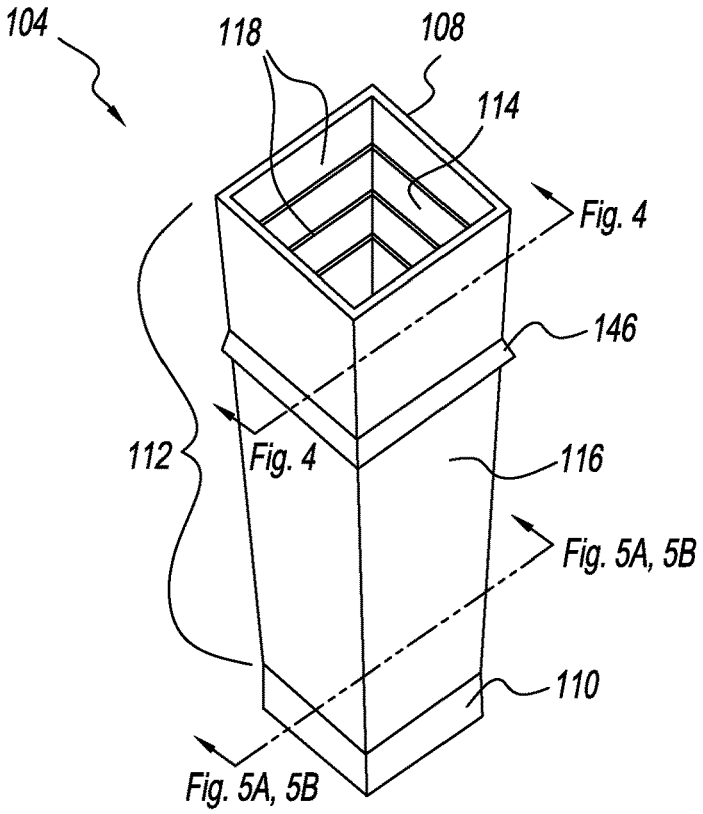
FIG. 2 is an isometric view of the current invention.

Turning now to FIG. 2, which shows the post support device's outer surface 116 and inner surface 114, which, in combination with the bottom end 110, form the body 112. The body 112 is interposed between the top opening 108 and the bottom end 110, and defines a space therein. In the preferred embodiment, the body 112 consists of four planar sides joined at a 90-degree angle to one another, forming a tapered rectangular prism shape. In another embodiment, the body 112 comprises a tapered cylindrical shape.

In an alternative embodiment, the top opening 108 may consist of a trimmable portion. In this embodiment, the top opening 108 material is a narrower thickness relative to the body 112 of the rigid insert portion 104. The user may remove this trimmable top opening 108 section to shorten the length of the rigid insert portion 104, thereby reducing the depth of the cavity into which the rigid insert portion 104 is mounted. This adaptability permits the user to quickly and easily adjust to a wide range of post member 102 lengths.

In the preferred embodiment, the rigid insert portion 104 comprises a hydrophobic material which prevents or slows moisture intrusion. Materials suitable for construction of the rigid insert portion 104 include, but are not limited to, reinforced concrete, moldable hydrophobic plastics such as high-density polyethylene and low-density polyethylene, corrosion resistant metals, or other moldable hydrophobic polymers.

The body 112 of the rigid insert portion 104 has a thickness of at least 2.5 millimeters, ideally between 3.8 and 5.7 millimeters. The rigid insert portion 104, however, can be fabricated from a thicker or thinner material depending on expected weather and stabilizing material 106 conditions at the install site.

In the preferred embodiment, the rigid insert portion 104 has a stacking stop 146 integrated with the outer surface 116 of the body 112. The stacking stop 146 extends at least 12 millimeters from the outer surface 116 of the body 112. This stacking stop 146 facilitates damage-free transportation, handling, and storage of the post support device, and permits multiple post support devices to be stacked in a minimal amount of space, thereby reducing storage and shipping expenses.

Integrated into the inner surface 114 of the body 112 is a retainer member support 118. The retainer member support 118 extends from 1 to 20 millimeters from the inner surface 114. The retainer member supports 118 are parallel to the top opening 108 and spaced at least 5 millimeters from any other retainer member support 118. Ideally, the spacing of each retainer member support 118—relative to other retainer member supports 118—is 25 millimeters to better accommodate a typical retainer member 122.

In the preferred embodiment, the retainer member support 118 consists of two parts forming an "L" shape. The first portion forms the base of the "L," and the second portion forms the top of the "L." Together these two portions create a ledge which comprises the retainer member support 118.

Figure 3:
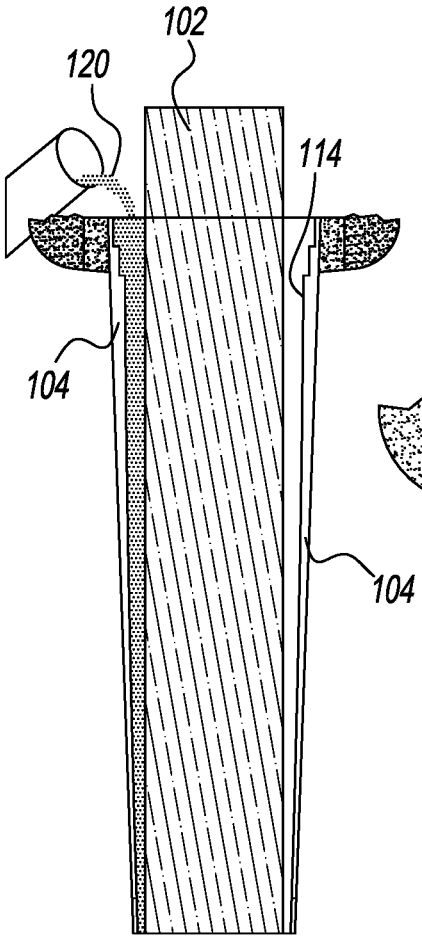
FIG. 3 is a side view depicting the granular material being poured into the current invention.

FIG. 3 depicts the granular material 120. The granular material 120 supports the post member 102 by filling the space adjacent the post member 102 and the inner surface 114 of the rigid insert portion 104. The granular material 120 also wicks moisture from the surface of the post member 102, lessening decomposition of the post member 102.

The granular material 120 consists of silica sand, fine crumb rubber, or other granular material capable of supporting the post member 102. In the preferred embodiment, the diameter of the granular material 120 ranges from 0.060 millimeters to 6.5 millimeters.

FIG. 3 also depicts the post member 102. In the preferred embodiment of the invention, the post member 102 is selected from a group of hard-or-softwood angiosperms or conifers, such as ash, redwood, oak, pine, or maple. In another embodiment, the post member 102 consists of a metal such as aluminum, steel, or iron. In yet another embodiment, the post member 102 consists of a hybrid material capable of supporting a fencing structure.

Figure 4:
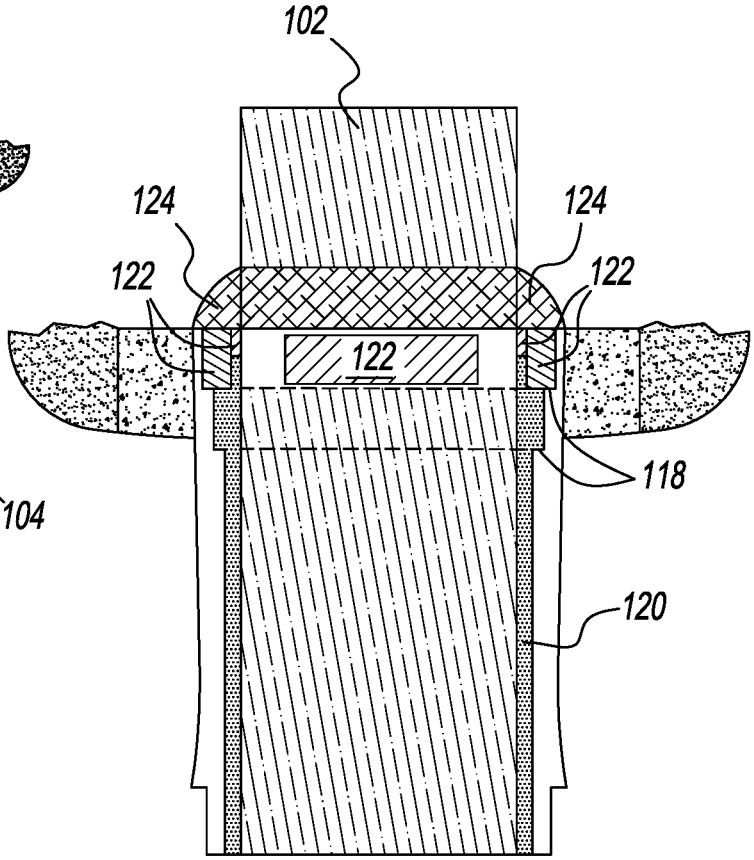
FIG. 4 is a partial sectional view, along line 4-4 in FIG. 2, of the upper portion of the current invention as installed in a stabilizing material.

FIG. 4 shows the retainer member 122. The retainer member 122 comprises a moisture resistant material, such as treated wood, plastic, or galvanized steel. The retainer member 122 is adapted to fit the post member 102. The shape, therefore, can be concave, flat, or notched to be received in a similarly notched post member 102, or any other shape which is adapted to fit the inserted post member 102. Shaping the retainer member 122 provides additional strength to the post support device by maximizing surface area contact between the post member 102 and the retainer member 122.

FIG. 4 also shows the sealant portion 124. The sealant portion 124 may consist of a semi-permanent moldable inorganic or organic substance—such as a silicone-based sealant or butyl rubber—which is resistant to the ingress of moisture. The sealant portion 124 also secures the retainer members 122, thereby preventing loosening of the post member 102.

Figure 5A:
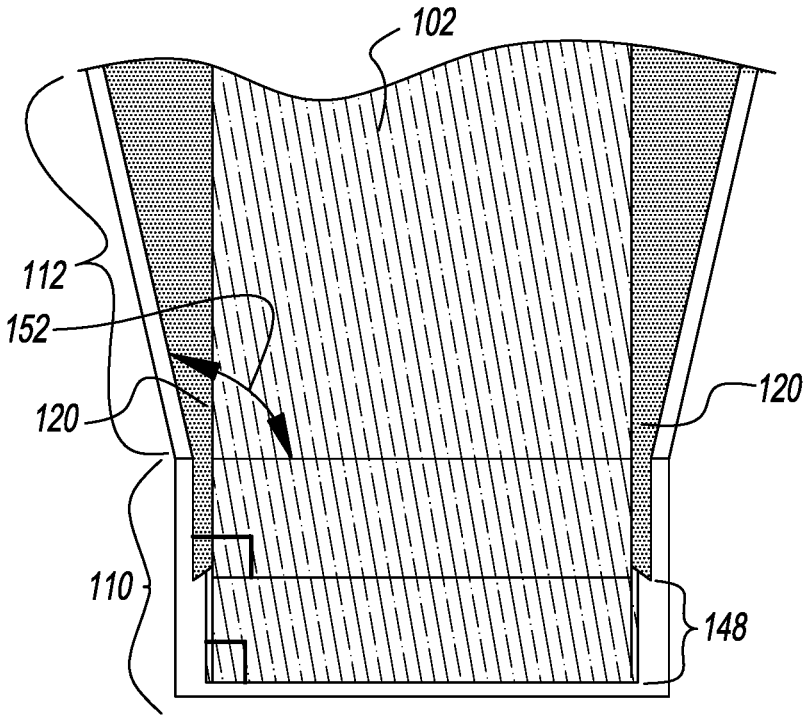
FIG. 5*a* is a partial sectional view, along the FIG. 5*a*-5*a* line in FIG. 2, of the lower portion of the current invention.

Next, shown in FIG. 5*a* is the bottom end angle 152, or the angle at which the body 112 and bottom end 110 joins. The bottom end angle 152 is greater than or equal to 91 degrees and less than or equal to 100 degrees. The bottom end angle 152 results in a tapered body 112 that facilitates location of the post member 102 in the post support device.

The bottom end 110 is designed to closely conform to the desired post member 102 dimensions, which allows the bottom end 110 to secure the distal end of the post member 102. In the preferred embodiment, the bottom end 110 comprises four sides that join the base at a ninety-degree angle. The base of the bottom end 110 is sized at least 1/32 of an inch larger than the post member 102. In the preferred embodiment, the base of the bottom end 110 is sized 1/8 of an inch larger than the post member 102. For example, for a 4 inch by 4 inch by 8-foot post member, the bottom end 110 would comprise a 4 and 1/8 by 4 and 1/8-inch base. This size results in a bottom end 110 which releasably secures the post member 102.

Figure 5B:
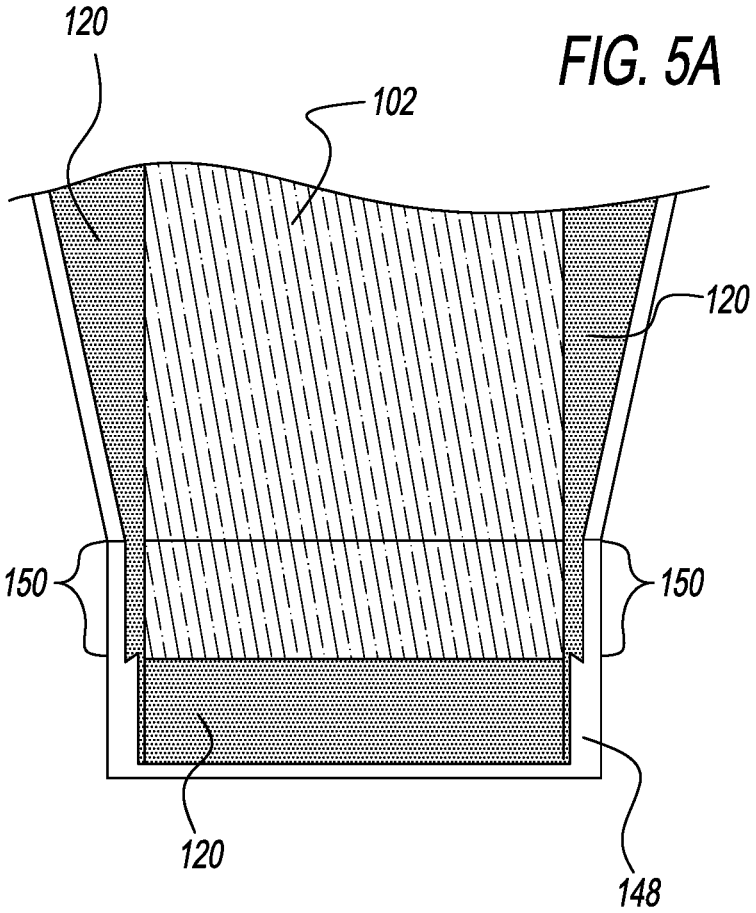
FIG. 5*b* is a partial sectional view, along the FIG. 5*b*-5*b* line in FIG. 2, of the lower portion of the current invention wherein the lower bottom end is filled with a granular material.

FIGS. 5*a* and 5*b* also show how the post support device can be adapted to accommodate post members 102 of varying dimensions. Wood milling is imprecise and wood post members 102 are often irregularly shaped. The present invention allows the installer to use a granular material 120 to easily adjust for irregular post member 102 dimensions.

To accomplish this adjustment, the post support device's bottom end 110 consists of graduated sections. In the preferred embodiment, the graduated sections consist of a lower bottom end 148 and an upper bottom end 150. If the post member 102 is too large to fit in the lower bottom end 148, the user fills the lower bottom end 148 with the granular material 120. Filling the lower bottom end 148 with the granular material 120 creates a new, larger upper bottom end 150 which supports the larger post member 102.

Figure 6:
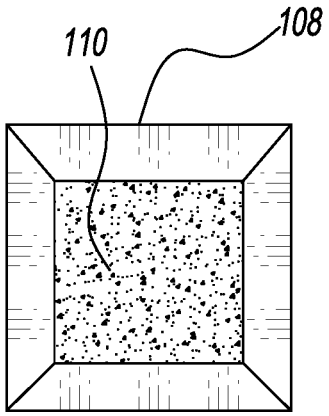
FIG. 6 is a top view of the current invention.

FIG. 6 shows the arrangement of the top opening 108 and the bottom end 110. The top opening 108 and the bottom end 110 are concentric with one another, and the bottom end 110 has a narrower cross section than the top opening 108. This arrangement allows the bottom end 110 to releasably secure a post member while permitting a looser fit at the top opening 108, increasing adjustability and easing replacement of the post member 102.

Figure 7:
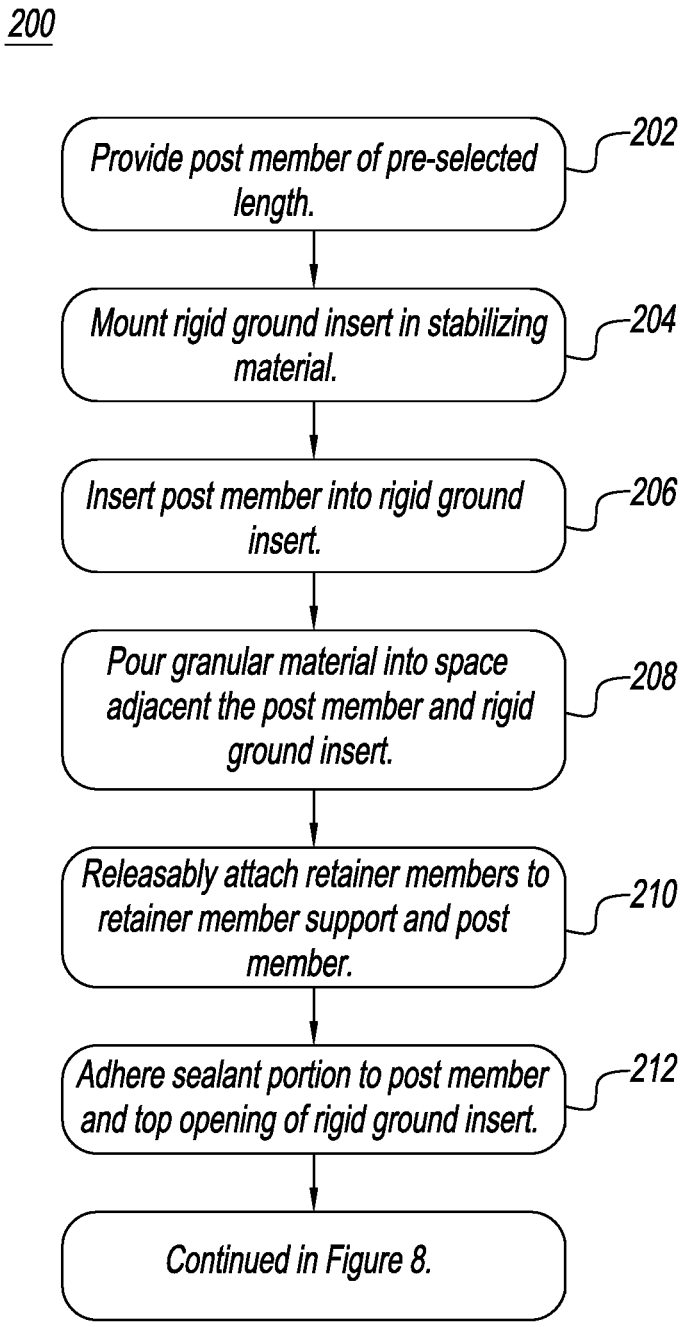
FIG. 7 is a flow diagram for a method of installing the current invention.

Turning now to FIG. 7, which shows the steps in a method of installing the post support device.

At step 202, a post member of pre-selected length is provided. Next, in step 204, the rigid insert portion is provided and mounted in a stabilizing material.

Next, in step 206, the pre-selected post member is inserted into the body of the rigid insert portion and into the bottom end. The rigid insert portion is manufactured in different dimensions to accommodate different sized post members. For example, with a common 4 inch by 4 inch×8 foot post member the bottom end of the rigid insert portion is sized slightly larger than the post member. The rigid insert portion size difference ranges from 1/32 of an inch to 3/4 of an inch larger than the post member. In the preferred embodiment, the rigid insert portion is sized an 1/8 of an inch larger than the post member, or 4 and 1/8 inches by 4 and 1/8 inches. This permits snug attachment of the post member in the bottom end of the rigid insert portion, facilitating step 208.

In step 208, the granular material is poured into the space adjacent the post member and rigid insert portion to the adjustment depth. The adjustment depth of the rigid insert portion is between 5 and 25 percent of the capacity of the rigid insert portion. In the preferred embodiment, the adjustment depth is 25 percent of the rigid insert portion's capacity. Filling the post member to the adjustment depth permits the leveling of the post member in the rigid insert portion. Filling the rigid insert portion to an adjustment depth greater than 25 percent prevents any lateral adjustment of the post member.

After the post member is adjusted, the rigid insert portion is filled to the final depth. The final depth ranges from 75 to 100 percent of the rigid insert portion's capacity. In the preferred embodiment, the final depth of the granular material is 90 percent of the capacity of the rigid insert portion.

Next, in step 210, the post member is releasably secured in the rigid insert portion by at least one retainer member. In the preferred embodiment, four retainer members are placed on each side of a rectangular post member, securing the post member in the desired orientation. In another embodiment, a plurality of retainer members are placed around the circumference of a cylindrical post member. The retainer members fit tightly between the post member and the rigid insert portion.

Next, in step 212, the sealant portion is adhered in communication with the top opening of the rigid insert portion, the retainer member, and the post member. The sealant is removable to facilitate replacement of the post member, if desired.

Figure 8:
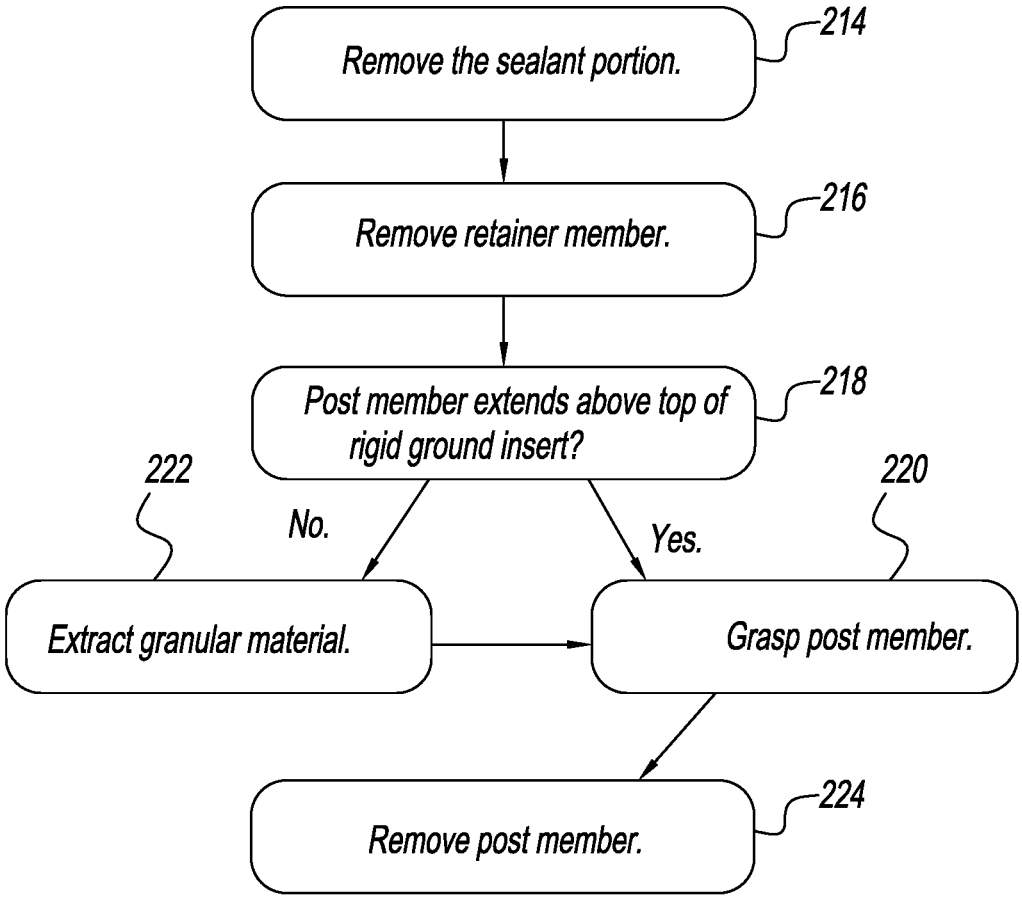
FIG. 8 is a flow diagram for a method of replacing a post member mounted in the current invention.

The steps as shown in FIG. 8 illustrate a method of replacing a post member. In step 214, the sealant portion is removed from the post support device. With the sealant portion removed, the user, in step 216, removes the retainer member. Next, in step 218, the user determines whether the post member extends above the top opening of the rigid insert portion.

If the post member extends above the top opening of the rigid insert portion, the user in step 220, grasps the post member and in step 224 removes the post member from the rigid insert portion. In the preferred embodiment, removal of the post member occurs in this manner, i.e. without needing to remove the granular material.

If the post member is significantly decomposed, the user must take additional steps as outlined in step 222. Significant decomposition occurs when the post member is too decomposed to be removed. If the post member is significantly decomposed or does not extend above the top opening of the rigid insert portion the user, in step 222, removes sufficient granular material to reveal the significantly decomposed post member. This enables the user to grasp and remove the post member. Granular material removal may be accomplished by hand or with assistance of a vacuum. Once the retainer member, sealant portion, and granular material are removed from the post support device, the significantly decomposed post member is removed in step 224.

This method allows the post support device to replace a damaged or deteriorated post, or to change the post member to a more desirable material.

The above-disclosed preferred and alternative embodiments are for illustrative purposes, and the scope of the present invention is to be limited only by the claims as interpreted in light of the prior art.

We claim:

1. A post support device comprising:

a rigid insert portion having:

a top opening and a bottom end, the top opening positioned opposite the bottom end, the bottom end enclosed by at least one side portion and one base portion, the bottom end further comprising at least one graduated section, the graduated section having a side portion and a ledge portion, the side portion of the graduated section extending from and being oriented perpendicular to the bottom end base portion and having a width narrower than the width of the bottom end side portion, the ledge portion inclining in a direction from the at least one side portion of the bottom end to the side portion of the graduated section, a body interposed between the top opening and bottom end, the body defining a space therein, an inner surface and an outer surface, at least one retainer member support fixed to the inner surface of the body, wherein the bottom end is concentric with the top opening and the bottom end has a cross section less than a cross section of said top opening, such that the body of the rigid insert portion and the bottom end intersect at an obtuse angle.

2. The invention of claim 1, wherein the rigid insert portion further comprises a hydrophobic material.

3. The invention of claim 1, wherein the body of the rigid insert portion further comprises a cylindrical shape.

4. The invention of claim 1, wherein the body of the rigid insert portion further comprises a plurality of planar sides which form a tapered rectangular prism shape.

5. The invention of claim 1, wherein the obtuse angle is less than or equal to 100 degrees.

6. The invention of claim 1, wherein the top opening further comprises a trimmable section.

7. A post support device comprising:

a rigid insert portion mounted in a stabilizing material, said rigid insert portion having:

a top opening and a bottom end, the top opening positioned opposite the bottom end and concentric with the bottom end, the bottom end enclosed by at least one side portion and one base portion, a body interposed between the top opening and the bottom end, the body defining a space therein, said bottom end having a cross section less than a cross section of said top opening, such that the body of the rigid insert portion and the bottom end intersect at an obtuse angle, the bottom end further comprising at least one graduated section, the graduated section having a side portion and a ledge portion, the side portion of the graduated section extending from and being oriented perpendicular to the bottom end base portion and having a width narrower than the width of the bottom end side portion, the ledge portion inclining in a direction from the at least one side portion of the bottom end to the side portion of the graduated section, an inner surface and an outer surface, at least one retainer member support fixed to the inner surface of the body, a granular material, a plurality of retainer members, and a sealant portion, wherein the granular material is placed in the space adjacent to a post member, the retainer member is releasably fixed in communication with the retainer member support and the post member, and the sealant portion is applied in communication with the top opening of the rigid insert portion and the post member, thereby releasably securing the post member.

8. The invention of claim 7, wherein the rigid insert portion further comprises a hydrophobic material.

9. The invention of claim 7, wherein the body of the rigid insert portion further comprises a cylindrical shape.

10. The invention of claim 7, wherein the body of the rigid insert portion further comprises a plurality of planar sides which form a tapered rectangular prism shape.

11. The invention of claim 7, wherein the obtuse angle is less than or equal to 100 degrees.

12. The invention of claim 7, wherein the top opening further comprises a trimmable section.

13. A method for releasably mounting a post member comprising the steps of:

providing a post member of pre-selected length, providing a rigid insert portion having:

a top opening and a bottom end, the top opening positioned opposite the bottom end and concentric with the bottom end, the bottom end enclosed by at least one side portion and one base portion, a body interposed between the top opening and the bottom end, said body defining a space therein, the bottom end having a cross section less than a cross section of said top opening, such that the body of the rigid insert portion and the bottom end intersect at an obtuse angle, the bottom end further comprising at least one graduated section, the graduated section having a side portion and a ledge portion, the side portion of the graduated section extending from and being oriented perpendicular to the bottom end base portion and having a width narrower than the width of the bottom end side portion, the ledge portion inclining in a direction from the at least one side portion of the bottom end to the side portion of the graduated section, and an inner surface and an outer surface, at least one retainer member support fixed to the inner surface of the body, mounting the rigid insert portion in a stabilizing material, inserting the post member through the top opening and body of the rigid insert portion, releasably attaching the post member to the bottom end of the rigid insert portion, pouring a granular material in the space adjacent the post member to an adjustment depth, adjusting the post member to a desired orientation, pouring the granular material in the space adjacent the post member to a final depth, releasably attaching at least one retainer member in communication with the retainer member support and the post member, and adhering a sealant portion in communication with the top opening of the rigid insert portion and the post member.

14. The method of claim 13 further comprising the step of removing the sealant portion.

15. The method of claim 14 further comprising the step of removing the retainer member.

16. The method of claim 15 further comprising the step of grasping the post member and removing the post member.

17. The method of claim 16 further comprising removing the granular material to a depth equal to a height of the ledge portion of the graduated section.

18. The method of claim 17 further comprising the step of inserting the post member through the top opening and body of the rigid insert portion and releasably attaching the post member in the graduated section of the bottom end.

* * * * *